US008507421B2

(12) United States Patent
Zaki

(10) Patent No.: US 8,507,421 B2
(45) Date of Patent: Aug. 13, 2013

(54) LUBRICATING GREASES AND PROCESS FOR THEIR PRODUCTION

(75) Inventor: Nael Naguib Zaki, Shawnee, KS (US)

(73) Assignee: Fuchs Lubricants Co., Harvey, IL (US)

( * ) Notice: Subject to any disclaimer, the term of this patent is extended or adjusted under 35 U.S.C. 154(b) by 188 days.

(21) Appl. No.: 13/014,629

(22) Filed: Jan. 26, 2011

(65) Prior Publication Data

US 2011/0190177 A1 Aug. 4, 2011

Related U.S. Application Data

(60) Provisional application No. 61/300,608, filed on Feb. 2, 2010.

(51) Int. Cl.
*C10M 115/10* (2006.01)
*C10M 169/06* (2006.01)

(52) U.S. Cl.
USPC ..... 508/405; 508/136; 508/154; 508/390; 508/519; 508/552

(58) Field of Classification Search
USPC ..... 508/390, 403–418
See application file for complete search history.

(56) References Cited

U.S. PATENT DOCUMENTS 3,249,537 A 5/1966 Arnold et al.
4,392,967 A * 7/1983 Alexander ..... 508/454
4,409,112 A 10/1983 Urmy, Jr.

FOREIGN PATENT DOCUMENTS

DE 102010006745 2/2010

OTHER PUBLICATIONS

Chemie et al., "Ligninsulfonsaure", ISBN 3-13-734810-2, vol. 3, 10th edition, 1997, p. 2411 (2 pages).
Fredheim et al., "Comparison of Molecular Weight and Molecular Weight Distributions of Softwood and Hardwood Lignosulfonates", Journal of Wood Chemistry and Technology, vol. 23, No. 2, 2003, pp. 197-215.
Fredheim et al., "Molecular weight determination of lignosulfonates by size-exclusion chromatography and multi-angle laser scattering", Journal of Chromotography A, vol. 942, Issues 1-2, 2002, pp. 191-199.
Office Action for DE Application No. 102010006745.8, mail date Jul. 7, 2010, 3 pages.
International Search Report for International Patent Application No. PCT/DE2011/000087, dated Jun. 6, 2011, 11 pages.

* cited by examiner

*Primary Examiner* — Ellen McAvoy
(74) *Attorney, Agent, or Firm* — Foley & Lardner LLP

(57) ABSTRACT

A process includes adding an effective amount of a calcium lignin sulfonate to a thickened base grease to form a lubricating grease wherein the calcium lignin sulfonate has a molecular weight of at least 10,000 g/mol; the calcium lignin sulfonate has a water content of less than about 0.5 wt %; the effective amount is from about 1 wt % to about 20 wt % based upon the weight of the lubricating grease; the thickened base grease is obtained from a grease forming process or a lubricating paste; and the lubricating grease has a water solubility below about 3 wt %, as determined by a water wash out-test.

20 Claims, No Drawings

LUBRICATING GREASES AND PROCESS FOR THEIR PRODUCTION

CROSS-REFERENCE TO RELATED APPLICATIONS

This application claims the benefit of U.S. Provisional Application Ser. No. 61/300,608, filed Feb. 2, 2010, which is incorporated herein by reference in its entirety for any and all purposes.

FIELD

The present technology generally relates to lubricating greases, and in particular to lubricating greases which include calcium lignin sulfonate as a lubricating grease additive that reacts with the grease thickener and is incorporated as part of the grease thickener and a process for the production of such lubricating greases.

BACKGROUND

Lignin sulfonates are produced from the naturally, occurring renewable material lignin through sulfonation. For the ease of reference, lignin sulfonate(s) are generally referred through out this application as LS.

Calcium LS (also known as calcium lignosulfonate), is a complex polymer of phenylpropane units, which are cross-linked to each other with a variety of different chemical bonds. Lignin is present in plant cells together with cellulose and hemicellulose. Lignin sulfonate is obtained as a by-product of paper manufacturing from tree pulps. Pulping is the term used for the process which separates wood fibers. Chemical pulping that dissolves the lignin in the wood to create a pulp, is the most common pulping process. The two main types of chemical pulping are the more common sulfate pulping (commonly known as Kraft pulping) and sulfite pulping.

The lubricants industry and, in particular, the lubricating grease industry, is interested in new replacements for molybdenum disulfide and other extreme pressure and anti-wear additives. Another incentive to find replacements for molybdenum disulfide and other additives is the ever increasing prices of these raw materials and their eroding supplies. Due to the decreasing supplies of oils and other petrochemical sources, the industry is now forced to find renewable resources, if possible, when formulating lubricants and lubricating greases.

SUMMARY

In one aspect, a process is provided including reacting an effective amount of a calcium lignin sulfonate with a thickened base grease to form a lubricating grease, where: the calcium lignin sulfonate has a molecular weight of at least 10,000 g/mol; the calcium lignin sulfonate has a water content of less than about 0.5 wt % after addition to the grease; the effective amount is from about 1 wt % to about 20 wt % based upon the weight of the lubricating grease; the thickened base grease is obtained from a grease forming process or a lubricating paste; and the lubricating grease has a water solubility below about 3 wt %, as determined by a water wash out-test. In some embodiments, the thickened base grease includes a soap thickened grease, an organic thickened grease, or an inorganic thickened grease. In some embodiments, the calcium lignin sulfonate has a molecular weight of at least 12,000 g/mol; an elemental sulfur content ranging from 2 to 10 wt %; a phenolic group content ranging from 1 to 5 wt %; carboxylic acid groups ranging from 2 to 10 wt %; and an elemental calcium content of not less than 5 wt %. In some embodiments, the calcium lignin sulfonate is dehydrated prior to reacting with the thickened base grease. In some embodiments, the calcium lignin sulfonate is added to the base grease at a temperature from about 82° C. to about 110° C. The calcium lignin sulfonate reacts with the grease thickener portion and is incorporated as a part of the thickener component of the lubricating grease.

In another aspect, a lubricating grease is provided including from 1 to 20 wt % of a calcium lignin sulfonate having a molecular weight of at least 10,000 g/mol, wherein the calcium lignin sulfonate is reacted into the lubricating grease. In some embodiments, the calcium lignin sulfonate has a molecular weight of greater than 12,000 g/mol. In other embodiments, the lubricating grease includes 40 to 90 wt % base oil; 5 to 55 wt % grease forming component; and 1 to 10 wt % additives other than calcium lignin sulfonate. In some embodiments, the base oil is an naphthenic oil, a paraffinic oil, a polyalphaolefin, a polyalkylene glycol, a polybutene, a polyisobutylene, a silicone oil, or a petroleum resin.

DETAILED DESCRIPTION

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment (s).

As used herein, the following definitions of terms shall apply unless otherwise indicated.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

According to various aspects, LS is described for use as part of the grease thickener, an anti-wear additive, an antioxidant, and a rust preventative in grease formulations. In some embodiments, the LS is calcium lignin sulfonate. The embodiments show that LS imparts enhanced properties to the lubricating grease, such as improved load carrying capacity, wear protection, oxidation resistance, and rust preventative characteristics. The enhancement in extreme pressure properties and load carrying capacity occurred when using LS as an additive. These properties were found unmatched by other single lubricating grease additives at the same concentration. The LS was successfully used as an additive for lubricating grease that belongs to different soap chemistries.

According to one embodiment, the lignin sulfonate is obtained as a result of the sulfite pulping process, and, accordingly, it has a relatively high calcium content. In one embodiment, the calcium content of the lignin sulfonate is greater than 5 wt %. In other embodiments, the calcium content of the lignin sulfonate is greater than 8 wt %.

According to other embodiments, the lignin sulfonate also and a molecular weight of 10,000 g/mol or greater. For example, in one such embodiment, the molecular weight is 12,000 g/mol, or greater. Such molecular weights are measured by high pressure size exclusion chromatography and are stated as the weight average molecular weight ($M_w$). Calcium lignin sulfonate as used throughout this invention as well comprises derivatives obtained through chemical transformation of the calcium lignin sulfonate.

In one aspect, lubricating greases are provided which include calcium lignin sulfonate, also called calcium lignosulfonate, as a lubricating grease additive. However, the calcium lignin sulfonate is not just added to the lubricating grease, it is reacted into the grease such that it becomes part of the grease structure, as described below. In another aspect, a process is provided for the production of such lubricating greases. According to various embodiments, such lubricating greases include, but are not limited to, organic thickened greases, inorganic thickened greases, and soap thickened greases. Inorganic thickened greases may include, but are not limited to, non-soap thickened greases such as bentone or clay thickened greases; and silica thickened greases, and soap thickened greases.

It is important to emphasize that the above mentioned types of greases have a well defined thickener structure, which includes the calcium lignin sulfonate, where the oil molecules are held within this structure. This is different from lubricating suspensions, where lubricating solids are suspended in the lubricating oil without the formation of a defined grease structure. The lubricating suspensions are simply lubricating oils containing various types of solids that are suspended in the oil and do not have a defined jelling structure that confine the oil within their matrix. The lubricating greases have a defined dropping point (i.e. a certain temperature at which oil separation occurs). On the other hand lubricating suspensions separate oil at room temperature.

According to one embodiment, a lubricating grease is provided that includes from about 1 wt % to about 20 wt % of a calcium lignin sulfonate having a molecular weight of greater than 10,000 g/mol. For example, the calcium lignin sulfonate may have a molecular weight of greater than 12,000 g/mol. Such greases may contain addition components such as, but not limited to, a base oil, a grease-forming material, an antioxidant, and an anti-wear additive, among others. For example, according to one embodiment, the lubricating grease includes from about 40 wt % to about 90 wt % of a base oil, from about 5 wt % to about 55 wt % of a grease forming component, and from about 1 wt % to about 10 wt % of other additives such as, but not limited to anti-oxidants, an anti-wear additives, and the like. The calcium lignin sulfonate functions in the lubricating grease as a combination extreme pressure additive, anti-wear additive, and antioxidant additive.

The lubricating greases described herein, are intended to be used in, but not limited to, lubricating surface mining machinery (pins and bushings, open gears in large electric shovels), constant velocity joints (CV joints), ball bearings, journal bearings, high speed low load machinery lubrication, low speed-high load machinery lubrication, conveyor belt bearings lubrication, gears lubrication, open gears lubrication, curve and flange rail lubrication, traction motor gear lubrication, high temperature highly corrosive media lubrication, wheel bearing lubrication of motor vehicles and trucks, journal bearing lubrication of freight and high speed trains, paper machinery lubrication, lawn and garden machinery lubrication, pipe dope anti seize lubrication, automotive tie rod ends, roof, seating and steering mechanism lubrication, jacks and landing gear equipment lubrication, continuous castor and hot mills bearing lubrication, lubrication of garage door mechanisms and oven chain lubrication. It is important to note that there are many other applications that the greases can be used which are not mentioned here, but are well known to the artisans. Such lubricating greases are soap thickened greases where the lubricating grease is thickened by a metal soap such as a lithium soap, a lithium complex soap, an aluminum complex soap, a calcium soap, a calcium complex soap, a sodium soap, a calcium sulfonate complex soap, and all other metal soaps of fatty acids. The lubricating greases are thickened by organic soaps such as polyurea soaps. The lubricating greases are thickened by inorganic material that has the ability to gel the oil and form a grease such as bentone and silica thickened greases.

Suitable base oils include, but are not limited to naphthenic oils, paraffinic oils, polyalphaolefin oils, polyalkylene glycol oil, polyalkylene glycol, polybutene, polyisobutylene, silicon oil, or a petroleum resin. The base oil provides viscosity to the grease. According to one embodiment, the base oil has an average kinematic viscosity at 40° C. of from about 40 cSt (centistokes) to about 460 cSt. In some embodiments, the base oil has an average kinematic viscosity at 40° C. of from about 250 cSt to about 300 cSt. In some embodiments, the base oil has an average kinematic viscosity at 40° C. of about 280 cSt.

In some embodiments, where the base oil is a polyalphaolefin oil, the base oil may have an average kinematic viscosity at 40° C. of from about 40 cSt to about 1260 cSt. In some such embodiments, where the base oil is a polyalphaolefin oil, the base oil may have an average kinematic viscosity at 40° C. of from about 40 cSt to about 60 cSt. In some such embodiments, where the base oil is a polyalphaolefin oil, the base oil may have an average kinematic viscosity at 40° C. of about 47 cSt.

In some embodiments, where the base oil is a polyalkylene glycol, the base oil may have an average kinematic viscosity at 40° C. of from about 40 cSt to about 10,000 cSt. In some such embodiments, where the base oil is a polyalkylene glycol, the base oil may have an average kinematic viscosity at 40° C. of about 200 cSt to about 400 cSt. In some such embodiments, where the base oil is a polyalkylene glycol, the base oil may have an average kinematic viscosity at 40° C. of about 280 cSt.

In some embodiments, where the base oil is a polybutene, the base oil may have an average kinematic viscosity at 40° C. of from about 1,000 cSt to about 200,000 cSt. In some such embodiments, where the base oil is a polybutene, the base oil may have an average kinematic viscosity at 40° C. of about 25,000 cSt to about 75,000 cSt. In some such embodiments, where the base oil is a polybutene, the base oil may have an average kinematic viscosity at 40° C. of about 50,000 cSt.

In some embodiments, where the base oil is a polyisobutylene, the base oil may have an average kinematic viscosity at 40° C. of from about 40 cSt to about 460 cSt. In some such embodiments, where the base oil is a polyisobutylene, the base oil may have an average kinematic viscosity at 40° C. of about 250 cSt to about 300 cSt. In some such embodiments, where the base oil is a polyisobutylene, the base oil may have an average kinematic viscosity at 40° C. of about 280 cSt.

In some embodiments, where the base oil is a silicon oil, the base oil may have an average kinematic viscosity at 40° C. of from about 500 cSt to about 10,000 cSt. In some such embodiments, where the base oil is a silicon oil, the base oil may have an average kinematic viscosity at 40° C. of about 1,000 cSt to about 5,000 cSt. In some such embodiments, where the base oil is a silicon oil, the base oil may have an average kinematic viscosity at 40° C. of about 2,000 cSt.

In some embodiments, where the base oil is a petroleum resin, the base oil may have an average kinematic viscosity at 40° C. of from about 40,000 cSt to about 60,000 cSt. In some such embodiments, where the base oil is a petroleum resin, the base oil may have an average kinematic viscosity at 40° C. of about 50,000 cSt.

Suitable anti-oxidants for use in the grease are those that are known to those of skill in the art. For example, the anti-oxidant may include, but is not limited to, amine-based anti-oxidants and hindered alkyl phenols. Illustrative amine-based anti-oxidants include, but are not limited to diphenyl amine.

In another aspect, a process is provided for forming a lubricating grease. The process includes adding 1 to 20 wt % based on the weight of the lubricating grease, of a calcium lignin sulfonate having a molecular weight ($M_w$) of above 10,000 g/mol to a thickened base grease. The thickened base grease is one which is obtained from a grease forming process or a lubricating paste. Other materials may be optionally added to the grease (i.e. "additives"). The calcium lignin sulfonate is preferably dried either prior to the addition or during the addition to the grease so that the water content of the calcium lignin sulfonate is less than 0.5 wt %. For example, the water content of the calcium lignin sulfonate may be less than 0.4 wt %, less than 0.3 wt %, less than 0.2 wt %, or less than 0.1 wt %, according to various embodiments. The lubricating grease produced from the process has a water solubility measured by a water wash out-test of less than 3 wt %. For example, the lubricating grease may have a water solubility of less than 2.5 wt %, less than 2 wt %, less than 1.5 wt %, or less than 1 wt %, according to various embodiments. As used herein the water wash-out test used is that as defined by ASTM D-1264.

According to various embodiments, the lubricating grease produced in the process is a soap thickened grease, and the soap thickener comprises at least one of lithium, both simple and complex, aluminum, calcium, both simple and complex, barium, sodium, potassium, and magnesium salts of $C_8$ to $C_{32}$ fatty acids, dicarboxylic acids, preferably azelaic acid and sebacic acid, hydroxy fatty acids, preferably 12-hydroxystearic acid, and/or hydrogenated castor oil.

According to various embodiments, the lubricating grease produced in the process is a soap thickened grease is a salt of a calcium salt and/or a calcium complex salt of one or more C8- to C32 fatty acids, dicarboxylic acids, particularly azelaic acid and sebacic acid, hydroxy fatty acids, particularly 12-hydroxystearic acid, and/or hydrogenated castor oils.

According to various embodiments, the lubricating grease produced in the process is an organic thickened grease. The organic thickened grease may be, but is not limited to, a salt of stearylamidoterephthalic acid; polyurea; diurea; triurea; or tetraurea.

According to various embodiments, the lubricating grease produced in the process is an inorganic thickened grease. The inorganic thickened grease may be, but is not limited to, oleophilic bentone (clay) thickened greases, and/or silica thickened greases. In some embodiments, the lubricating paste is made of inorganic particles dispersed in an oil liquid at 25° C.

The calcium lignin sulfonate used in the greases has a molecular weight (Mw) of greater than about 10,000 g/mol. For example, the molecular weight may be greater than about 12,000 g/mol. In some embodiments, the molecular weight of the calcium lignin sulfonate is greater than 15,000 g/mol. The calcium lignin sulfonate may have an elemental sulfur content ranging from about 2 wt % to about 10 wt %. In some embodiments, the calcium lignin sulfonate has a phenolic group content ranging from about 1 wt % to about 5 wt %. In some embodiments, the calcium lignin sulfonate has a content of carboxylic acid groups ranging from about 2 wt % to about 10 wt %. In some embodiments, the calcium lignin sulfonate has an elemental calcium content of from about 5 wt % to about 10 wt %. For example, the calcium lignin sulfonate may have an elemental calcium content of not less than 5 wt %. In some embodiments, the calcium lignin sulfonate has an elemental calcium content of less than 8 wt %.

As noted above, the calcium lignin sulfonate is to be dried prior to, or during incorporation into the grease. It is important to emphasize that the presence of a substantial amount of water incorporated in LS in the grease will impart undesirable traits on the grease. These disadvantageous traits are lower dropping point, poor water resistance of the grease, and lower ability of the grease to resist corrosion. In addition to these disadvantageous effects, the grease mechanical stability in the presence of water is compromised. The mechanical stability of lubricating greases are very important trait of lubricating greases. A lubricating grease with poor mechanical stability tends to flow out of the lubrication area, which leads to loss of lubrication and failure of the lubricated machinery. Therefore, all, or substantially all of the water is removed from the LS prior to, or during, the grease manufacturing process. In some embodiments, substantially all of the water means that the CaLS contains less than about 2 wt % water. In some embodiments, substantially all of the water means that the CaLS contains less than about 1 wt % water. In some embodiments, substantially all of the water means that the CaLS contains less than about 0.5 wt % water. In some embodiments, substantially all of the water means that the CaLS contains less than about 0.1 wt % water.

In some embodiments, the calcium lignin sulfonate is dehydrated and/or freed from water prior to its addition to the grease. This may be accomplished by forming a slurry with a base oil and heating the slurry to above about 100° C. prior to the addition of the slurry to the base grease. In other embodiments, the calcium lignin sulfonate is added to the base grease at a temperature from about 80° C. to about 110° C. In yet other embodiments, the calcium lignin sulfonate is added to the base grease at a temperature below about 110° C. In yet other embodiments, the calcium lignin sulfonate is added to the base grease at a temperature above about 80° C.

In various embodiments, the process may include adding other materials (i.e. "additives"). For example, such additive may include, but are not limited to, amine-based antioxidants, molybdenum dithiocarbamate, molybdenum dithiophospate, molybdenum disulfide, zinc dialkyldithiophosphate, over-based calcium sulfonate, or solid lubricants such as calcium hydroxide, calcium carbonate, sodium tetraborate, potassium tetraborate, boron nitride, calcium phosphate, graphite, molybdenum disulfide, talc, polytetrafluoroethylene, or mixtures of any two or more such additives. However, the lubricating greases described herein do not contain sodium fluoantimonate or non-ionic polymers of ethylene oxide.

The calcium lignin sulfonate may be added to the grease in an amount of from about 1 wt % to about 10 wt %. In some embodiments, the calcium lignin sulfonate is added to the grease in an amount of from about 4 wt % to about 6 wt %. In some embodiments, the calcium lignin sulfonate is added to the base grease when it has from about 20 wt % to about 70 wt % of the base oil, with the residual base oil of about 80 wt % to about 30 wt % added together with the calcium lignin sulfonate or thereafter.

In some embodiments of the process, the base oil is one or more members of lubricating oil base stock groups I, II, or III, as classified by the API (American Petroleum Institute). Group I base stocks are composed of fractionally distilled petroleum which is further refined with solvent extraction processes to improve certain properties such as oxidation resistance and to remove wax. Group II base stocks are composed of fractionally distilled petroleum that has been hydrocracked to further refine and purify it. Group III base stocks have similar characteristics to Group II base stocks, except that Group III base stocks have higher viscosity indexes. Group III base stocks are produced by further hydrocracking of Group II base stocks, or of hydroisomerized slack wax, (a byproduct of the dewaxing process). Group IV base stock are polyalphaolefins (PAOs). Group V is a catch-all group for any base stock not described by Groups I to IV. Examples of Group V base stocks include polyol esters, polyalkylene glycols (PAG oils), and perfluoropolyalkylethers (PFPAEs). Groups I and II are commonly referred to as mineral oils, Group III is typically referred to as synthetic, and Group IV is a synthetic oil. Group V base oils are so diverse that there is no catch-all description.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

The present invention, thus generally described, will be understood more readily by reference to the following examples, which are provided by way of illustration and are not intended to be limiting of the present invention.

EXAMPLES

General: The measurement of the molecular weight ($M_w$) of the lignin sulfonates was determined by size exclusion chromatography as described by Fredheim et al. *J. Wood Chemistry and Technology* 23(2); 197-215, 2003; and Fredheim et al. *Journal of Chromatography A* 942(1-2); 191-199, 2002. The mobile phase for the molecular weight determination is a phosphate-DMSO-SDS, stationary phase, with a column packing of Jordi-Glukose•DVB. The calcium LS used in the examples is commercially available as Norlig II D or Borrement Ca 120, both available from Borregard Lignotech.

Example 1

Lithium 12-Hydroxy Stearate Grease. The grease was manufactured in an open kettle. About 50% of the base oil was pumped to the cooking vessel and the fatty acids (fats) were added to the kettle and the temperature was raised above the highest melting point of the fats. At about 93-98° C., lithium hydroxide monohydrate and water were added to start the saponification process. The temperature was raised gradually to reach the highest temperature designed for this reaction which reaches about 210-220° C. The grease was then pumped to a finishing kettle where it was cooled gradually. When the temperature reached about 93-110° C., calcium lignin sulfonate salt (Norlig II D) was added gradually to the grease in the finishing kettle. Lignin sulfonate was added at this temperature (93-110° C.) because it contained moisture. At this temperature, any traces of moisture present in the LS were driven off. The grease was milled and mixed thoroughly with the Calcium LS. Thereafter, further additives and further oil was added to the grease to obtain the desired consistency (NLGI grade or degree of softness) of the lubricating grease.

Comparison between the performance of a lithium 12-hydroxy stearate that contains Calcium LS and that that contains molybdenum disulfide.

TABLE 1

Grease Formulations With $MoS_2$ and With LS.

| Component Name | Grease with $MoS_2$ [wt %] | Grease with LS [wt %] | Function of the ingredient |
|---|---|---|---|
| Naphthenic Mineral Oil (Kinematic Viscosity @ 40° C. = 280 cSt | 80.85 | 85.85 | Base Oil |
| 12-Hydroxystearic acid | 6.00 | 6.00 | Fat |
| Water | 0.85 | 0.85 | Facilitates Saponification Reaction |
| Lithium Hydroxide Monohydrate | 1.8 | 1.8 | Facilitates Saponification Reaction |
| Molybdenum dithiocarbamate | 1. 5 | | Friction Modifier Additive |

TABLE 1-continued

Grease Formulations With $MoS_2$ and With LS.

| Component Name | Grease with $MoS_2$ [wt %] | Grease with LS [wt %] | Function of the ingredient |
|---|---|---|---|
| Diphenyl Amine | 0.50 | 0.5 | Antioxidant additive |
| Hindered Alkyl Phenol | 0.5 | | Antioxidant additive |
| 5,5 dithiobis (1,3,4-thiadiazole-2(3H)thione) | 2.0 | | Extreme Pressure Additive |
| Zinc Dialkyldithiophosphate | 1.0 | | Anti-wear Additive |
| Molydbenum Disulfide | 5.0 | | Extreme Pressure Additive |
| Norlig 11 D Calcium Lignin Sulfonate | | 5.00 | Extreme Pressure, anti-wear, antioxidant additive |

TABLE 2

Testing of the Grease Formulations of Table 1.

| Test | Method | Grease with $MoS_2$ | Grease with LS | Remarks |
|---|---|---|---|---|
| Cone Penetration 0X | ASTM D-217 | 285 | 281 | |
| Cone Penetration 60X | ASTM D-217 | 283 | 282 | Same penetration range |
| 4-Ball Wear Scar Diameter | ASTM D-2266 | 0.59 mm | 0.52 mm | 12% better |
| 4-Ball Weld Point | ASTM D-2596 | 250 kgf | 620 kgf | 4 steps better |
| Bleed 96 hrs 60° C. | In House Method | 3.33% | 3.12% | 6% better |
| Rust Bearing Test | ASTM D-1743 | Pass | Pass | Same Results |
| Cu Corrosion | ASTM D-130 | 1B | 1B | Slightly more discoloration of copper |
| Drop Point | ASTM D-2265 | 200° C. | 189° C. | Lower Drop Point |
| FAG FE 8 | 50 kN, 75 rpm, 500 hrs | Passed 500 hours test (0.118 g wear) | Passed 500 hours test (0.082 g wear) | Very good, lower mass loss |

As seen from the table of comparison, the addition of Calcium LS instead of $MoS_2$ imparted desirable traits to the lubricating grease. The grease load carrying capacity was increased by orders of magnitude from 250 Kgf to 620 Kgf. The wear was reduced more than in the case of $MoS_2$, as shown by the FAG FE8 bearing test and the wear scar diameter test. The FAG FE 8 test which is designed to measure the performance of lubricating grease in actual bearing lubrication applications showed that the grease containing LS lower mass loss of the bearing elements than the case of using $MoS_2$. In this context, it is notable to know that the costs of the $MoS_2$ are 20 times more expensive than LS.

Example 2

Lithium Complex Grease. The grease was cooked in an open kettle. About 50% of the base oil was pumped to the cooking vessel, then the fatty acids (fats) were added to the kettle and the temperature was raised above the highest melting point of the fats. At about 93-98° C., lithium hydroxide monohydrate and water were added to start the saponification process. The temperature was raised gradually to reach the highest temperature designed for this reaction which reaches about 210-220° C. The grease was then pumped to a finishing kettle where it was cooled gradually. When the temperature reached about 93-110° C., calcium lignin sulfonate was added gradually to the grease in the finishing kettle. At this temperature any traces of moisture present in the LS was driven off. The grease was milled and mixed thoroughly with the Calcium LS. Thereafter the other additives and further oil were added to the grease to obtain the desired consistency (NLGI grade or degree of softness) of the lubricating grease.

TABLE 3

Grease Formulations With $MoS_2$ and With LS.

| Component Name | Grease with $MoS_2$ [wt %] | Grease with LS [wt %] | Function of the ingredient |
|---|---|---|---|
| Naphthenic Mineral Oil (Kinematic Viscosity @ 40° C. = 280 cSt | 78.79 | 83.79 | Base Oil |
| 12-Hydroxystearic acid | 6.00 | 6.00 | Fat |
| Azelaic Acid | 1.80 | 1.80 | Fat |
| Water | 0.85 | 0.85 | Facilitates Saponification Reaction |
| Lithium Hydroxide Monohydrate | 2.06 | 2.06 | Facilitates Saponification Reaction |
| Molybdenum dithiocarbamate | 1.5 | | Friction Modifier Additive |
| Diphenyl Amine | 0.50 | 0.50 | Antioxidant additive |
| Hindered Alkyl Phenol | 0.50 | | Antioxidant additive |
| 5,5 dithiobis (1,3,4-thiadiazole-2(3H)thione) | 2.0 | | Extreme Pressure Additive |
| Zinc Dialkyldithiophosphate | 1.0 | | Anti-wear Additive |
| Molydbenum Disulfide | 5.0 | | Extreme Pressure Additive |
| Norlig 11 D Calcium Lignin Sulfonate | | 5.00 | Extreme Pressure, anti-wear, antioxidant additive |

TABLE 4

Testing of the Grease Formulations of Table 3.

| Test | Method | Grease with $MoS_2$ | Grease with LS | Remarks |
|---|---|---|---|---|
| Cone Penetration 0X | ASTM D-217 | 285 | 285 | |
| Cone Penetration 60X | ASTM D-217 | 289 | 282 | Same penetration range |
| 4-Ball Wear Scar Diameter | ASTM D-2266 | 0.55 mm | 0.45 mm | Better |
| 4-Ball Weld Point | ASTM D-2596 | 400 kgf | >800 kgf | 4 steps better |
| 4-Ball Load Wear Index | ASTM D-2596 | 50 | 159 | >Three Times Better |

TABLE 4-continued

Testing of the Grease Formulations of Table 3.

| Test | Method | Grease with $MoS_2$ | Grease with LS | Remarks |
|---|---|---|---|---|
| Rust Bearing Test | ASTM D-1743 | Pass | Pass | Same Results |
| Cu Corrosion | ASTM D-130 | 1B | 1B | Slightly more discoloration of copper |
| Drop Point | ASTM D-2265 | 200° C. | 189° C. | Lower Drop Point |
| FAG FE 8 Wear Expressed as Mass Loss | 50 kN, 75 rpm, 500 hrs | Passed 500 hours test (0.113 g wear) | Passed 500 hours test (0.054 g wear) | Very good, lower mass loss |
| FAG FE 8 Wear Maximum Measured Torque (Nm) | 50 kN, 75 rpm, 500 hrs | 48 | 5 | Lower Torque and Better Lubrication |

It is clear from the above example that LS increased tremendously the load wear index of the lithium complex grease as compared to the $MoS_2$ containing grease. Addition of Calcium LS decreased the wear scar diameter and decreased the overall wear as seen from the FAG FE8 bearing testing, where the grease is used to lubricate tapered roller bearings and run under 50 kN load at a speed of 75 rpm for 500 hrs. The measured torque is plotted as a function of time, and the grease passes the lest if the measured torque does not exceed a certain threshold value. The threshold torque value for this set of conditions is 60 Nm.

Example 3

Aluminum Complex Grease. The grease was cooked in an open kettle. where about 50% of the base oil was pumped to the cooking vessel, and then stearic acid and benzoic acid were added. The mixture was heated to 180-190° F., then aluminum isopropoxide was added to the mixture. The temperature was raised gradually to reach the highest temperature designed for this reaction which reaches about 140° C. The grease was then pumped to a finishing kettle where it was cooled gradually. When the temperature reached about 93-110° C., calcium lignin sulfonate was added gradually to the grease in the finishing kettle. At this temperature, traces of moisture present in the LS were driven off. The grease was milled and mixed thoroughly with the LS and then the remaining additives and further oil were added to obtain the desired consistency (NLGI grade or degree of softness) of the lubricating grease.

TABLE 5

Grease Formulations With and Without LS.

| Component Name | Grease without LS [wt %] | Grease with LS [wt %] | Function of the ingredient |
|---|---|---|---|
| Naphthenic Mineral Oil (Kinematic Viscosity @ 40° C. = 280 cSt | 84.06 | 81.56 | Base Oil |
| Stearic Acid | 5.64 | 5.64 | Fat Soap Component |
| Benzoic Acid | 2.5 | 2.5 | Soap Component |
| Water | 0.80 | 0.80 | Facilitates Saponification Reaction |
| Aluminum Isopropoxide | 4.00 | 4.00 | Gelling Agent |
| Antimony Sulfur Based Olefin | 2.00 | | Extreme Pressure Additive |
| Diphenyl Amine | 0.50 | 0.50 | Antioxidant additive |
| Hindered Alkyl Phenol | 0.50 | | Antioxidant additive |
| Norlig 11 D Calcium Lignin Sulfonate | | 5.00 | Extreme Pressure, anti-wear, antioxidant additive |

TABLE 6

Testing of the Grease Formulations of Table 5.

| Test | Method | Grease without LS | Grease with LS | Remarks |
|---|---|---|---|---|
| Cone Penetration 0X | ASTM D-217 | 275 | 278 | |
| Cone Penetration 60X | ASTM D-217 | 284 | 282 | Same penetration range |
| 4-Ball Wear Scar Diameter | ASTM D-2266 | 0.77 mm | 0.50 mm | Better |
| 4-Ball Weld Point | ASTM D-2596 | 315 kgf | 620 kgf | 3 steps better |
| 4-Ball Load Wear Index | ASTM D-2596 | 60 | 124 | More than double |
| Rust Bearing Test | ASTM D-1743 | Pass | Pass | Same Results |
| Cu Corrosion | ASTM D-130 | 1B | 1B | Slightly more discoloration of copper |
| Drop Point | ASTM D-2265 | 260° C. | 240° C. | Lower Drop Point |

The addition of LS to Aluminum Complex Thickened grease resulted in a better load carrying capacity better wear protection.

Example 4

Calcium 12-Hydroxy Stearate/Calcium Stearate Thickened Grease. A grease as defined in the following tables was cooked in an open kettle. where about 50% of the base oil was pumped to the cooking vessel, then the fats including 12-hydroxy stearic acid and stearic acid, calcium hydroxide, and water were added. The mixture was heated to 120° C. The grease was then pumped to a finishing kettle where it was cooled gradually. When the temperature reached about 93-110° C., calcium lignin sulfonate was added gradually to the grease in the finishing kettle. Calcium lignin sulfonate was added at a temperature of 93-110° C. At this temperature traces of moisture present in the LS was driven off. The grease was milled and mixed thoroughly with the L and thereafter other additive were added to the grease and further oil to obtain the desired consistency (NLGI grade or degree of softness) of the grease.

TABLE 7

Grease Formulations A and B.

| Component Name | Grease A [wt %] | Grease B with LS [wt %] | Function of the ingredient |
|---|---|---|---|
| Naphthenic Mineral Oil (Kinematic Viscosity @ 40° C. = 280 cSt | 70.20 | 76.10 | Base Oil |
| Stearic Acid | 2.00 | 2.00 | Fat Soap Component |
| 12-Hydroxy Stearic Acid | 6.50 | 6.50 | Fat Soap Component |
| Water | 0.80 | 0.80 | Facilitates Saponification Reaction |
| Calcium Hydroxide | 2.00 | 2.00 | Gelling Agent |
| Micronized Borate | 1.5 | | Anti-wear Additive |
| Additive Package | 2.00 | 0.50 | Antioxidant, anti-wear, and extreme pressure additive |
| Natural Graphite | 10.00 | | Solid Lubricant Additive |
| Calcium Carbonate | 5.00 | 5.00 | Solid anti-wear additive |
| Dimercapto Thiadiazole | | 0.1 | Copper Deactivator additive |
| Diphenyl Amine | | 0.50 | Antioxidant additive |
| Norlig 11 D | | 7.00 | Extreme Pressure, anti-wear, antioxidant additive |
| Calcium Lignin Sulfonate | | | |

TABLE 8

Testing of the Grease Formulations of Table 7.

| Test | Method | Grease A | Grease B with LS | Remarks |
|---|---|---|---|---|
| Cone Penetration 0X | ASTM D-217 | 275 | 275 | |
| Cone Penetration 60X | ASTM D-217 | 278 | 280 | Same penetration range |
| 4-Ball Wear Scar Diameter | ASTM D-2266 | 0.65 mm | 0.40 mm | Better |
| 4-Ball Weld Point | ASTM D-2596 | 315 kgf | >800 kgf | 4 steps better |
| 4-Ball Load Wear Index | ASTM D-2596 | 40 | 154 | More than double |
| Rust Bearing Test | ASTM D-1743 | Pass | Pass | Same Results |
| Cu Corrosion | ASTM D-130 | 1B | 1B | Slightly more discoloration of copper |
| Drop Point | ASTM D-2265 | 187° C. | 188° C. | Same Drop Point |

It is clear from the above example that L increased the load wear index of the calcium grease as compared to the grease without LS, which still contained other EP/AW additives. Addition of LS decreased the wear scar diameter and enhanced the weld point.

Example 5

Calcium Sulfonate Complex Thickened Grease. The grease was cooked in an open kettle, where about 20% of the base oil was pumped to the cooking vessel, thereafter the overbased calcium sulfonated, dodecyl benzene sulfonic acid, acetic acid, water, calcium carbonate, calcium hydroxide, and 12-hydroxy stearic acid were added. The mixture was heated gradually to 176° C. The grease is then pumped to a finishing kettle where it was allowed to cool. When the temperature reached about 93-110° C., calcium lignin sulfonate salt was added gradually to the grease in the finishing kettle. At this temperature the traces of moisture present in the LS was driven off. The grease is milled and mixed thoroughly with the LS and then other additives and further base oil were added to obtain the desired consistency (NLGI grade or degree of softness) of the grease.

TABLE 9

Grease Formulations With and Without LS.

| Component Name | Grease without LS [wt %] | Grease with LS [wt %] | Function of the ingredient |
|---|---|---|---|
| Naphthenic Mineral Oil (Kinematic Viscosity @ 40° C. = 280 cSt | 72.10 | 67.10 | Base Oil |
| Overbased Calcium Sulfonate | 10.00 | 10.00 | Fat Soap Component |
| 12-Hydroxy Stearic Acid | 6.50 | 6.50 | Fat Soap Component |
| Water | 0.80 | 0.80 | Facilitates Saponification Reaction |
| Calcium Hydroxide | 4.00 | 4.00 | Gelling Agent |
| Acetic acid | 1 | 1 | |
| Dimercapto Thiadiazole | 0.1 | 0.1 | Copper deactivator agent |
| Diphenyl Amine | 0.50 | 0.50 | Antioxidant additive |
| Calcium Carbonate | 5.00 | 5.00 | Solid anti-wear additive |
| Calcium Lignin Sulfonate | | 5.00 | Extreme Pressure, anti-wear, antioxidant additive |

TABLE 10

Testing of the Grease Formulations of Table 9.

| Test | Method | Grease without LS | Grease with LS | Remarks |
|---|---|---|---|---|
| Cone Penetration 0X | ASTM D-217 | 275 | 275 | |
| Cone Penetration 60X | ASTM D-217 | 278 | 280 | Same penetration range |
| 4-Ball Wear Scar Diameter | ASTM D-2266 | 0.55 mm | 0.42 mm | Better |
| 4-Ball Weld Point | ASTM D-2596 | 500 kgf | >800 kgf | 3 steps better |
| 4-Ball Load Wear Index | ASTM D-2596 | 65 | 158 | More than double |
| Rust Bearing Test | ASTM D-1743 | Pass | Pass | Same Results |
| Cu Corrosion | ASTM D-130 | 1B | 1B | Slightly more discoloration of copper |
| Drop Point | ASTM D-2265 | 280° C. | 280° C. | Same Drop Point |

As seen from the above table, the addition of the LS to the calcium sulfonate complex grease resulted in improved extreme pressure and anti-wear properties.

A similar procedure as for examples 1 to 5 can be followed in a pressure cooking kettle, such as Stratco contactor or autoclave, with the exception that the base oil, fats, metal compound, and water are charged at the beginning of the reaction. The grease is cooked in the closed pressure vessel and then pumped hot to the finishing kettle where the calcium can be added the same way as described for the open kettle cooking procedure.

Example 6

Bentone (Clay) Thickened Grease. Calcium LS was added to the base oil in a slurry tank, where it was heated at 100° C. to evaporate the moisture from the LS. The slurry of the LS in oil was then added to a kettle containing hydrophobized (treated) bentone, water and propylene carbonate as gelling agents, and other additives. The ingredients were mixed in the grease kettle and pumped through a grease mill and back to the kettle. The milling process thickened the grease and the required thickness is adjusted to the required penetration by adding oil to the grease.

TABLE 10

Grease Formulations With and Without LS.

| Component Name | Grease without $MoS_2$ but with LS [wt %] | Grease with $MoS_2$ [wt %] | Function of the ingredient |
|---|---|---|---|
| Naphthenic Mineral Oil (Kinematic Viscosity @ 40° C. = 280 cSt | 80.35 | 78.85 | Base Oil |
| Treated Bentone (Bentonite Rheological Additive) | 6.00 | 10.00 | Grease Thickener |
| Propylene Carbonate | 0.90 | 1.50 | Facilitates Grease Gelling |
| Water | 0.15 | 0.15 | Facilitates Saponification Reaction |
| Antimony Dialkyldithio-carbamate | | 1.50 | Extreme Pressure Additive |
| Molybdenum dialkyldithio-carbamate | | 1.50 | Friction Modifier Additive |
| 5,5-Dithiobis-(1,3,4-thiadiazole-2(3H)thione) | | 1.5 | Extreme Pressure Additive |
| Synthetic Graphite | | 2.00 | Extreme Pressure Solid Lubricating additive |
| Diphenyl Amine | 0.50 | 0.50 | Antioxidant additive |
| Hindered Alkyl Phenol | | 0.50 | Antioxidant additive |
| Molybdenum disulfide | | 2.00 | Extreme Pressure Additive |
| Norlig 11 D Calcium Lignin Sulfonate | 6.00 | | Extreme Pressure, anti-wear, antioxidant additive |
| Calcium Carbonate | 5.00 | | Solid anti-wear additive |
| Dimercapto Thiadiazole | 0.1 | | Copper Deactivator additive |
| Methylene bis(dibutyldithio-carbamate) | 1.00 | | Anti-wear additive |

TABLE 11

Testing of the Grease Formulations of Table 10.

| Test | Method | Grease without $MoS_2$ but with LS | Grease with $MoS_2$ | Remarks |
|---|---|---|---|---|
| Cone Penetration 0X | ASTM D-217 | 275 | 278 | |
| Cone Penetration 60X | ASTM D-217 | 284 | 282 | Same penetration range |
| 4-Ball Wear Scar Diameter | ASTM D-2266 | 0.72 mm | 0.56 mm | Better |
| 4-Ball Weld Point | ASTM D-2596 | 250 kgf | 400 kgf | 2 steps better |
| 4-Ball Load Wear Index | ASTM D-2596 | 23 | 60 | More than double |
| Rust Bearing Test | ASTM D-1743 | Pass | Pass | Same Results |
| Cu Corrosion | ASTM D-130 | 1B | 1B | Slightly more discoloration of copper |
| Water Washout, 175 F., % loss | ASTM D-1246 | 2 | 0.25 | Better wear resistance |
| Drop Point | ASTM D-2265 | 280° C. | 280° C. | Same Drop Point |

The addition of calcium LS to the clay grease resulted into load wear index improvements, higher 4-ball weld point and lower wear as seen from smaller wear scar diameter. The addition of LS to the bentone grease enhanced its performance to reach the performance of lithium complex greases, which traditionally have much better load carrying capacity and enhanced antiwear properties. However, bentone thickened greases generally have better drop points and work stability as compared to lithium complex greases. Therefore, the new bentone grease containing LS have better performance than the lithium complex greases and the traditional bentone greases combined.

Example 7

Silica (Highly dispersed Silicic Acid) Thickened Based Grease. The calcium LS was added to the base oil in a slurry tank, where it is heated at 100° C. to evaporate the moisture from the LS. The slurry of the LS in oil, was then added to a kettle containing fumed silica, and other additives. The ingredients were mixed in the grease kettle and pumped through a grease mill and back to the kettle. The milling process thickens the grease and the required thickness is adjusted to the required penetration by adding oil to the grease.

TABLE 12

Testing of the Grease Formulations With LS and Other Additives.

| Test | Method | Grease without LS and with other EP/AW Additives | Grease with LS | Remarks |
|---|---|---|---|---|
| Cone Penetration 0X | ASTM D-217 | 278 | 275 | |
| Cone Penetration 60X | ASTM D-217 | 284 | 280 | Same penetration range |
| 4-Ball Wear Scar Diameter | ASTM D-2266 | 0.74 mm | 0.42 mm | Better |
| 4-Ball Weld Point | ASTM D-2596 | 200 kgf | 400 kgf | 2 steps better |
| 4-Ball Load Wear Index | ASTM D-2596 | 21 | 56 | More than double |
| Rust Bearing Test | ASTM D-1743 | Pass | Pass | Same Results |
| Cu Corrosion | ASTM D-130 | 1B | 1B | Slightly more discoloration of copper |
| Drop Point | ASTM D-2265 | 280° C. | 280° C. | Same Drop Point |

The addition of L to the silica thickened grease resulted into much better load wear index improvements, higher 4-ball weld point and lower wear as seen from smaller wear scar diameter. The addition of LS to the silica thickened grease enhanced its performance to reach the performance of lithium complex greases, which traditionally have much better load carrying capacity and enhanced antiwear properties. However, silica thickened greases have better drop points and work stability as compared to lithium complex greases. Therefore, the new silica thickened grease containing LS showed better performance than the lithium complex greases and the traditional bentone greases combined.

Example 8

Polyurea Thickened Grease. A polyurea grease was prepared in a two step process. In the first step the MDI (di-4,4'-isocyanatophenylmethane) and fatty amines are separately dispersed in the base oil. In the second step the MDI dispersion was pumped over the amine dispersion in a sealed vessel. The mixture is heated to 180° C. The grease is pumped to a finishing kettle where L was added to the grease when the temperature cooled down to 110° C. The grease is then further cooled and thoroughly mixed and other performance additives were added to the mixture and thoroughly milled. The grease desired penetration range was adjusted by subsequent addition of oil to the grease, It is contemplated that any of the compositions described herein can possess any combination of the properties described above. It will be apparent to those skilled in the art that various modifications and variations can be made without departing from the scope or spirit of the invention in its broader aspects as defined in the following claims.

What is claimed is:

1. A process comprising:

reacting an effective amount of a calcium lignin sulfonate with a thickened base grease to form a lubricating grease;

wherein:

the calcium lignin sulfonate has a molecular weight of at least 10,000 g/mol;

the calcium lignin sulfonate has a water content of less than about 0.5 wt % after addition to the grease;

the effective amount is from about 1 wt % to about 20 wt % based upon the weight of the lubricating grease;

the thickened base grease is obtained from a grease forming process or a lubricating paste; and the lubricating grease has a water solubility below about 3 wt %, as determined by a water wash out-test.

2. The process of claim 1, wherein the thickened base grease comprises a soap thickened grease, an organic thickened grease, or an inorganic thickened grease.

3. The process of claim 2, wherein the thickened base grease comprises a soap thickened grease, and the soap thickener comprises at least one of simple lithium, complex lithium, aluminum, simple calcium, complex calcium, barium, sodium, potassium, and magnesium salts of $C_8$-$C_{32}$ fatty acids, dicarboxylic acids, hydroxy fatty acids, and hydrogenated castor oil.

4. The process of claim 3, wherein the dicarboxylic acid is azelaic or sebacic acid.

5. The process of claim 3, wherein the hydroxy fatty acid is 12-hydroxystearic acid.

6. The process of claim 2, wherein the soap thickened grease comprises a simple or complex calcium salt.

7. The process of claim 2, wherein the thickened base grease comprises the organic thickened grease selected from at least one member of the group consisting of salts of stearylamidoterephthalic acid, polyurea, diurea, triurea and tetraurea.

8. The process of claim 2, wherein the thickened base grease comprises the inorganic thickened grease selected from at least one member of the group consisting of oleophilic bentone (clay) thickened greases and silica thickened greases.

9. The process of claim 1, wherein the thickened base grease is obtained from the lubricating paste comprising inorganic panicles dispersed in an oil liquid at 25° C.

10. The process of claim 1, wherein the calcium lignin sulfonate has a molecular weight of at least 12,000 g/mol; an elemental sulfur content ranging from 2 to 10 wt %; a phenolic group content ranging from 1 to 5 wt %; carboxylic acid groups ranging from 2 to 10 wt %; and an elemental calcium content of not less than 5 wt %.

11. The process of claim 1, wherein the calcium lignin sulfonate is dehydrated prior to reacting with the thickened base grease.

12. The process of claim 1, wherein the calcium lignin sulfonate is dehydrated by forming a slurry with a base oil and heating the slurry to above about 100° C. prior to reacting with the thickened base grease.

13. The process of claim 1 further comprising adding additives to the thickened base grease.

14. The process of claim 13, wherein the additives comprise amine-based antioxidants, molybdenum dithiocarbamate, molybdenum dithiophospate, molybdenum disulfide, zinc dialkyldithiophosphate, overbased calcium sulfonate, calcium hydroxide, calcium carbonate, sodium tetraborate, potassium tetraborate, boron nitride, calcium phosphate, graphite, molybdenum disulfide, talc, polytetrafluoroethylene, or a mixture of any two or more thereof.

15. The process of claim 1, wherein the calcium lignin sulfonate is added to the base grease at a temperature from about 82° C. to about 110° C.

16. The process of claim 1, wherein the calcium lignin sulfonate is added to the base grease comprising 20 to 70 wt % of the base oil, with the residual base oil of 80 to 30 wt % added together with the calcium lignin sulfonate or thereafter.

17. A lubricating grease comprising 1 to 20 wt % of a calcium lignin sulfonate having a molecular weight of at least 10,000 g/mol, wherein the calcium lignin sulfonate has been chemically transformed such that the calcium lignin sulfonate forms a thickener structure within the lubricating grease.

18. The lubricating grease of claim 17, wherein the calcium lignin sulfonate has a molecular weight of greater than 12,000 g/mol.

19. The lubricating grease according to claim 17, further comprising:

a) 40 to 90 wt % base oil;

b) 5 to 55 wt % grease forming component; and c) 1 to 10 wt % additives other than calcium lignin sulfonate.

20. The lubricating grease of claim 17, wherein the base oil is an naphthenic oil, a paraffinic oil, a polyalphaolefin, a polyalkylene glycol, a polybutene, a polyisobutylene, a silicone oil, or a petroleum resin.

* * * * *